US006502773B1

(12) United States Patent
Hostettler et al.

(10) Patent No.: US 6,502,773 B1
(45) Date of Patent: Jan. 7, 2003

(54) FEED SENSOR SYSTEM AND METHOD OF OPERATION

(75) Inventors: René Hostettler, Sirnach (CH); Thomas Graber, Rorschach (CH)

(73) Assignee: Buhler AG, Uzwil (CH)

( * ) Notice: Subject to any disclaimer, the term of this patent is extended or adjusted under 35 U.S.C. 154(b) by 0 days.

(21) Appl. No.: 09/423,242

(22) PCT Filed: Mar. 25, 1998

(86) PCT No.: PCT/CH98/00116

§ 371 (c)(1),
(2), (4) Date: Nov. 5, 1999

(87) PCT Pub. No.: WO98/58738

PCT Pub. Date: Dec. 30, 1998

(30) Foreign Application Priority Data

Jun. 23, 1997 (DE) ..... 197 26 551

(51) Int. Cl.[7] ..... B02C 25/00
(52) U.S. Cl. ..... 241/34; 241/36; 241/37
(58) Field of Search ..... 241/34, 36, 37, 241/235, 225, 30; 73/861.75, 861.72

(56) References Cited

U.S. PATENT DOCUMENTS

| | | | | |
|---|---|---|---|---|
| 4,291,583 A | * | 9/1981 | Buike | |
| 4,442,980 A | | 4/1984 | Oetiker et al. | |
| 4,619,408 A | | 10/1986 | Sangati | |
| 4,881,689 A | | 11/1989 | Lippuner et al. | |
| 5,100,062 A | | 3/1992 | Baltensperger et al. | |
| 5,165,608 A | | 11/1992 | Baltensperger et al. | |
| 5,201,470 A | | 4/1993 | Baltensperger et al. | |
| 5,230,251 A | * | 7/1993 | Brandt, Jr. | 177/16 |
| 5,303,870 A | | 4/1994 | Baltensperger et al. | |
| 5,310,123 A | | 5/1994 | Baltensperger et al. | |
| 5,361,995 A | | 11/1994 | Hostettler et al. | |
| 5,368,239 A | | 11/1994 | Baltensperger et al. | |
| 5,373,997 A | | 12/1994 | Baltensperger et al. | |
| 5,485,965 A | | 1/1996 | Hostettler et al. | |
| RE35,202 E | | 4/1996 | Baltensperger et al. | |
| 5,544,823 A | | 8/1996 | Baltensperger et al. | |
| 5,561,250 A | * | 10/1996 | Myers | 73/861.73 |
| 6,220,103 B1 | * | 4/2001 | Miller et al. | 73/861.22 |

FOREIGN PATENT DOCUMENTS

| | | |
|---|---|---|
| DE | 12 14 979 | 4/1966 |
| DE | 2730166 | 1/1978 |
| DE | 3404732 | 8/1984 |
| DE | 86 14 505 | 11/1987 |
| DE | 88 17 253 | 2/1996 |
| EP | 0 038 054 | 10/1981 |
| EP | 0334919 | 4/1989 |
| EP | 0515596 | 6/1992 |
| GB | 2 103 389 | 2/1983 |
| WO | WO 92/10295 | 6/1992 |
| WO | WO 93/06928 | 4/1993 |

* cited by examiner

*Primary Examiner*—Mark Rosenbaum
(74) *Attorney, Agent, or Firm*—Finnegan, Henderson, Farabow, Garrett & Dunner, L.L.P.

(57) ABSTRACT

The invention relates to a feed sensor mechanism for a mill cylinder. The purpose of the invention is to provide a structurally simple sensor to detect the product in the entry port of the feed regulator. To this end, a sensor is located in the feed cylinder of the cylinder mill. The sensor is able to detect the force of the incoming product so that a control signal can then be sent to the feed device via a signal converter.

33 Claims, 2 Drawing Sheets

FEED SENSOR SYSTEM AND METHOD OF OPERATION

FIELD OF INVENTION

Background of Invention

The invention concerns a product feed control of a cylinder mill, especially a cylinder grain mill with an electric sensor, a product feeder with an adjustable drive for the feed, and a process to control such a cylinder mill.

To control the product feed of a cylinder grain mill, the set conditions must be maintained, i.e.:

Even product distribution over the entire length of the rollers,

The amount of product flowing to the cylinder mill must be processed within permissible tolerances, and the fluctuations in supply must be compensated as much as possible, When the product supply is interrupted, the product feed to the milling rollers must be stopped quickly, and the milling rollers must be disengaged.

For decades, basic elements such as distribution rollers and feed rollers have proven themselves along with mechanical probes as sensors for finely controlling the feed to the milling rollers. The use of capacitive sensors in such probes in the feed area is prior art in WO 93/06928. The same is true for infrared sensors. A minimum of two sensors is required, and usually more than 6 measuring points are provided. The momentary setting of the product amount being fed to the milling rollers can be controlled by regulating the speed of the feed rollers or the feed gap between a feed gate and the feed roller which is also termed segment adjustment. In practice, both speed control and segment adjustment are used. Such a speed control is e.g. described in DE-U-8614505. A segmental displacement of a product feed control is described in EP-A-38054. In the feed area of a cylinder mill is a vertical probe that has numerous angled rods. As is the case with mechanical scales, an analog mechanical signal is generated by various transmission members during the product flow that is converted into an analog pressure control signal in a downstream pneumatic value. This forms the input signal of a servo control for setting the product feed and/or the engagement/disengagement of the grinding drums.

A similar solution is found in GB-A-2103389 where the vertical, height-adjustable probe has several plate-shaped arms that are perpendicular to the product flow direction.

Such pneumatic mechanical feed controls are involved and friction-dependent. If the metered product has the constitution of flour or farina, segmental displacement is preferred. If the products are flakes such as whole-corn meal, speed control is often superior. Since the feed control design is predetermined for each cylinder mill and the mills are generally not converted afterward, individual jobs may not have the correct feed control. As described in greater detail in EP-B-515596, grinding is the heart of each mill, and controlling the product feed is particularly important. It has therefore been suggested that the feed control be provided with a first mechanical signal generator for a digital signal and a second mechanical signal generator for an analog signal to provide satisfactory stabilization. Such a mechanical system is not very costeffective, comparatively involved and it absorbs friction that changes and hence influences the measuring result.

Furthermore, such a mechanical system tends to get dirty and allows products to clog due to bridge formation.

The invention is therefore based on the problem of eliminating the described disadvantages and creating a simply-designed product capture system at the inlet that can be easily integrated in an automatic feed control. Another problem of the invention is to develop a procedure to control a cylinder mill, especially the product feed.

The product feed control is characterized in that the measuring signal is generated with just one sensor at the inlet. An elastic measuring strip is preferable. In the procedure according to the invention, a control signal is generated that controls the engagement and disengagement of the grinding rollers or basic positions of the product feed system. The sensor senses a static force component from the product flow proportional to the product amount above, and a dynamic force component depending on the composition and flow properties (especially the rate) of the product.

Changing friction coefficients from contact with the product largely do not Influence the measuring signal. There is practically no soiling or corresponding influence on the control signal.

The main advantage of the solution according to the invention is the technically simple product detection and easy adaptation to existing feed control systems such as in EP B 515596. In addition, there are no mechanically moving parts that can get dirty.

The shut-off/on point can be determined with just one sensor, and the feed control can be governed by the same received signal.

Using amplification in the prior-art electronic component, only a small force component of the product flow is necessary, and only a small amount of friction arises from the small sensor that is installed.

BRIEF DESCRIPTION OF THE DRAWINGS

The invention will be further explained in the following using an exemplary embodiment that refers to a drawing. Shown in the drawing are.

DETAILED DESCRIPTION OF INVENTION

Figure 1:
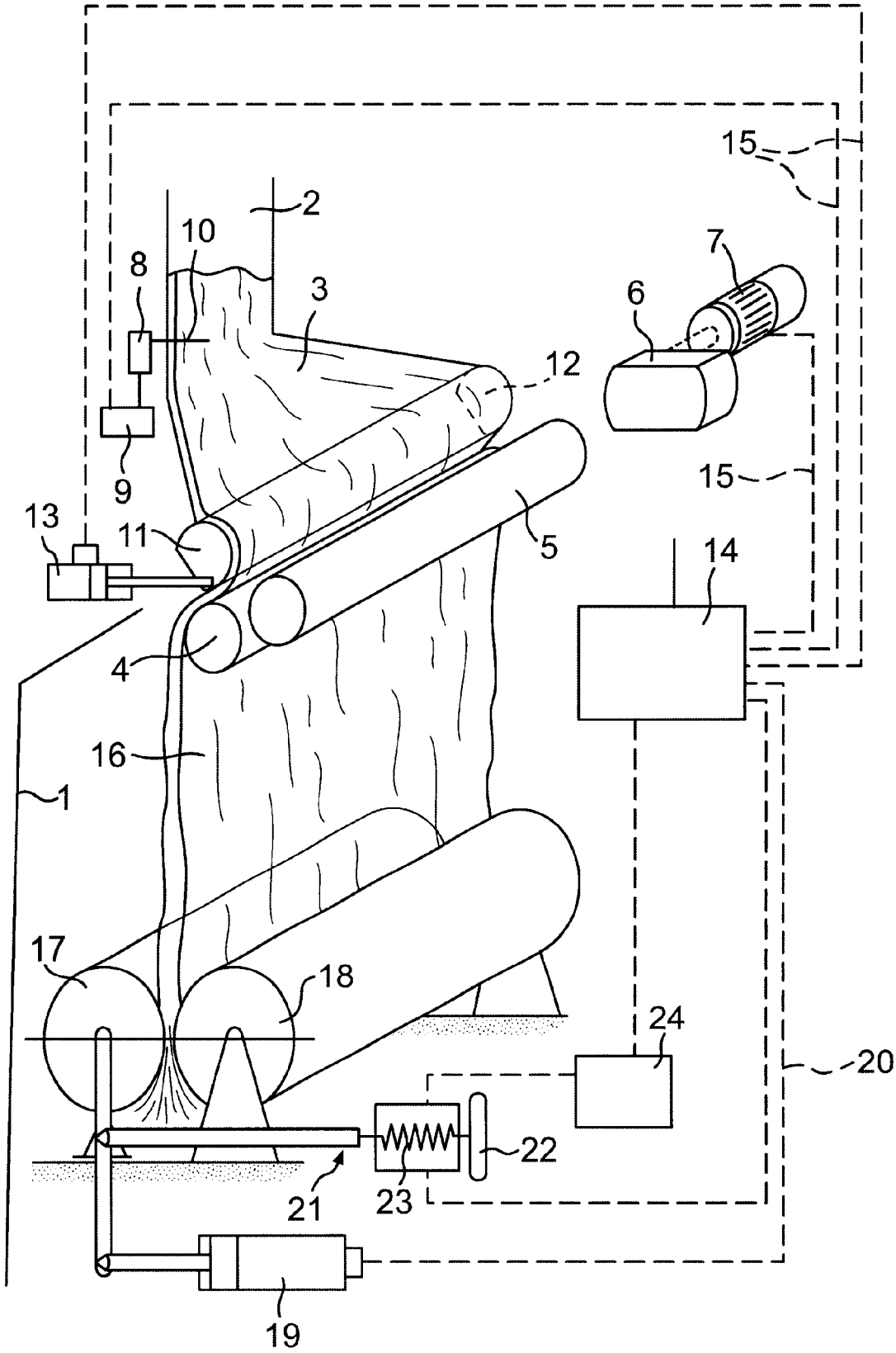
FIG. 1: Schematic representation of the basic elements of milling using cylindrical rollers.
Figure 2:
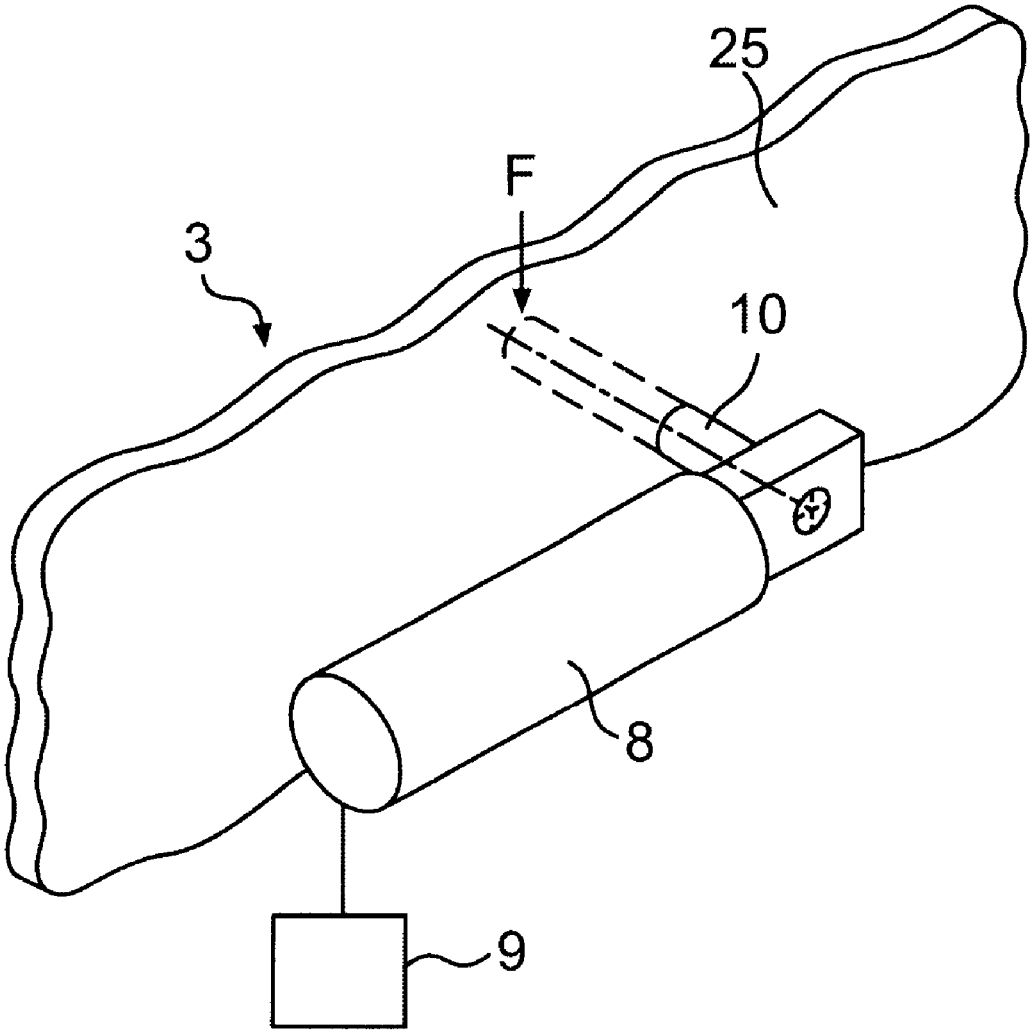
FIG. 2: The arrangement of the sensor at the inlet (product feed).

A cylinder mill 1 that is conventionally used in milling (e.g. as in EP B 334919 or DE C 2730166) contains a feed cylinder 2 with a product feed area that has a distribution roller 4 in the bottom part as well as a feed roller 5 that can be rotated in the same direction by gears 6 and a drive 7.

A sensor 8 is at the feed cylinder 2 that is directly connected to a signal converter 9, or the two can be combined as a unit. The sensor 8 transmits force from weight F as a signal to the signal converter 9. The weight F acts on a rod 10 of the sensor 8. The sensor 8 measures this force and transmits the information to the signal converter 9, and a strain gauge can be used on or as the rod 10. The signal converter 9 is connected directly or via another signal converter 14 to the feed device. The sensors 8, 10 can in principle be at any site next to the feed cylinder 2 or in the production feed area 3 before the distribution and feed rollers 4,5. In individual cases, it is conceivable to use a second sensor 8, e.g. when the feed control is subjected to high demands and/or the product flow conditions are complicated.

The rod 10 of the sensor 8 is articulated to a wall of the product feed area 3 and is dust tight.

A feed gap 11 is formed by a segment 12. A segment shifting device 13 is of the feed roller 5 or the position of the feed segment 12 can be influenced based on the signal of the sensor 8 and the signal converter 14 via connections 15, 15' drawn as dashed lines.

The material from the feed roller 5 is correspondingly fed (arrow 16) to a milling roller pair consisting of a fixed roller 18 and a loose roller 17. The loose roller 17 is assigned and engaging and disengaging device 19 that is controlled by the control signal from the sensor 8 via a control line 20. The loose roller 17 is also assigned a milling gap adjusting device 21 that can be adjusted by a handwheel 22 or motorized means 23, and an electronic memory/computer unit 24. This adjustment depends on or is a function of the specific milling job, the milled grain quality, or the throughput through the cylinder mill 1.

The actual feed control is carried out via the pneumatic or electric adjustment of the feed segment 12 or feed gap 11 disclosed in EP B 38054 or via a speed controller. The engagement/disengagement is controlled pneumatically or electrically.

List of Reference Numbers

1 Cylinder mill
2 Feed cylinder
3 Product feed area
4 Distribution roller
5 Feed roller
6 Gears
7 Drive
8 Sensor
9 Signal converter
10 Rod
11 Feed gap
12 Segment
13 Segment adjusting device
14 Signal converter
15, 15' Connection
16 Arrow
17 Loose roller
18 Fixed roller
19 Engaging/disengaging device
20 Control line
21 Milling gap adjustment device
22 Handwheel
23 Motorized means
24 Memory/computer unit
25 Wall

What is claimed is:

1. Apparatus for sensing the flow rate of a flowing stream of particulate matter in a milling operation, the particulate matter having a flow direction, the apparatus comprising:

a sensor device including a cantilevered rod disposable in the flowing stream substantially perpendicular to the flow direction, the sensor device being configured to allow elastic rod movement in the flow direction, and a sensor configured to detect an amount of elastic flexure within the sensor device due to forces acting on the rod caused by the flowing particulate matter; and a signal converter configured to provide a flow rate signal corresponding to the forces detected by the sensor.

2. The apparatus of claim 1, wherein the rod is elastic and the sensor device is configured to detect an amount of bending strain in the rod due to the forces acting on the rod caused by the flowing particulate matter.

3. The apparatus of claim 1, wherein the rod is attached to a portion of the sensor device in a manner to permit flexure between the rod and the portion of the sensor device to which the rod is attached and the sensor is configured to detect an amount of flexure in the rod due to the forces acting on the rod caused by the flowing particulate matter.

4. The apparatus of claim 1, wherein the sensor includes a strain gage for determining a strain associated with the rod movement in the flow direction.

5. The apparatus as in claim 1, further including a flow cylinder for establishing the flow direction wherein the sensor is outside of the flow cylinder and the cantilevered rod extends through the flow cylinder into the flowing stream, wherein the sensor is in a substantially dust free location.

6. The apparatus of claim 1, wherein a portion of the sensor device configured for disposal in the stream of particulate matter consists essentially of a single rod to minimize a disturbance to the flow of particulate matter.

7. Apparatus for controlling the flow of a stream of particulate matter comprising:

a conduit for establishing a direction of stream flow;

an adjustable feed gap for the stream, the gap defined at least in part by a segment assembly and a feed roller assembly;

an apparatus for adjusting the feed gap by adjusting at least one of: the segment assembly position, the feed roller assembly position, and speed of the feed roller assembly; and a sensor device for providing a signal corresponding to a flow rate of the stream, the sensor device including a rod cantilevered into the stream, the sensor device configured to allow elastic rod movement in the flow direction, and a sensor for providing a flow rate signal corresponding to an amount of elastic flexure within the sensor device due to forces acting on the rod caused by the stream of particulate matter, wherein the apparatus for adjusting the adjustable feed gap is operatively connected to the sensing device for controlling the flow of particulate matter through the adjustable feed gap.

8. The apparatus of claim 7, wherein the rod is elastic and the sensor device is configured to detect an amount of bending strain in the rod due to the forces acting on the rod caused by the flowing particulate matter.

9. The apparatus of claim 7, wherein the rod is attached to a portion of the sensor device in a manner to permit flexure between the rod and the portion of the sensor device to which the rod is attached and the sensor is configured to detect an amount of flexure in the rod due to the forces acting on the rod caused by the flowing particulate matter.

10. The apparatus of claim 7, wherein the rod is substantially perpendicular to the flow direction.

11. The apparatus of claim 7, wherein the sensor includes a strain gage for determining a strain associated with the rod movement in the flow direction.

12. The apparatus of claim 7, wherein the rod extends through a wall of conduit into the flowing stream, wherein the sensor is in a substantially dust free location.

13. The apparatus of claim 7, wherein a portion of the sensor device configured for disposal in the stream of particulate matter consists essentially of a single rod to minimize a disturbance to the flow of particulate matter.

14. Apparatus for controlling the flow of a stream of particulate matter comprising:

a feed cylinder for establishing a direction of stream flow;

a feed roller assembly including at least one feed roller positioned downstream of the feed cylinder and the sensor device relative to the stream of particulate matter, and a feed roller drive operatively connected to the feed roller;

a segment assembly including a segment shifting device positioned adjacent the feed roller assembly to establish a feed gap; and a sensor device for providing a signal corresponding to a flow rate of the stream;

the sensor device being positioned between the feed cylinder and the feed gap, and wherein the sensor device includes at least one rod cantilevered into the stream of particulate matter, the sensor device configured to allow elastic rod movement in the flow direction, and a sensor providing a flow rate signal corresponding to an amount of elastic flexure within the sensor device due to forces acting on the rod caused by the stream of particulate matter, and wherein at least one of the feed roller drive and the segment shifting device is operatively connected to the sensor device and the flow rate signal is used to adjust at least one of: a position of the segment shifting device, a speed of the feed roller, and a position of the feed roller.

15. The apparatus of claim 14, wherein the rod is elastic and the sensor device is configured to detect an amount of bending strain in the rod due to the forces acting on the rod caused by the flowing particulate matter.

16. The apparatus of claim 14, wherein the rod is attached to a portion of the sensor device in a manner to permit flexure between the rod and the portion of the sensor device to which the rod is attached and the sensor is configured to detect to an amount of flexure in the rod due to the forces acting on the rod caused by the flowing particulate matter.

17. The apparatus of claim 14, wherein the rod is substantially perpendicular to the flow direction.

18. The apparatus of claim 14, wherein the sensor includes a strain gage for determining a strain associated with the rod movement in the flow direction.

19. The apparatus of claim 14, wherein the rod extends through a wall of the conduit into the flowing stream, wherein the sensor is in a substantially dust free location.

20. The apparatus of claim 14, wherein a portion of the sensor device configured for disposal in the stream of particulate matter consists essentially of a single rod to minimize a disturbance to the flow of particulate matter.

21. Apparatus for grinding a flowing stream of particulate matter comprising:

a conduit for establishing a direction of stream flow;

a sensor device for providing a signal corresponding to the flow rate of the stream; the sensor device being positioned proximate to the conduit;

a feed roller assembly including at least one roller positioned downstream of the conduit and the sensor device relative to the stream of particulate matter and a feed roller drive operatively connected to the roller;

a segment assembly including a segment shifting device positioned adjacent the feed roller assembly, the segment assembly defining at least in part a feed gap; and a grinding roller apparatus for grinding the flowing stream of particulate matter having at least one adjustable grinding roller wherein adjusting the grinding roller includes at least one of: adjusting a milling gap by adjusting a grinding roller position and engaging or disengaging a grinding roller, wherein the sensor device includes at least one rod cantilevered in the stream of particulate matter, the sensor device configured to allow elastic rod movement in the flow direction, and a sensor providing a flow rate signal corresponding to an amount of elastic flexure within the sensor device due to forces acting on the rod caused by the stream of particulate matter, and wherein the flow rate signal is used to control at least one of: the feed roller drive by adjusting a feed roller speed, the segment shifting device by adjusting a segment shifting device position, an adjustable grinding roller, by engaging or disengaging the grinding roller, and a milling gap by adjusting grinding roller position.

22. The apparatus of claim 21, wherein the rod is elastic and the sensor device is configured to detect an amount of bending strain in the rod due to the forces acting on the rod caused by the flowing particulate matter.

23. The apparatus of claim 21, wherein the rod is attached to a different portion of the sensor device in a manner to permit flexure between the rod and the different portion of the sensor device and the sensor device is configured to detect to an amount of flexure in the rod due to the forces acting on the rod caused by the flowing particulate matter.

24. The apparatus of claim 21, wherein the rod is substantially perpendicular to the flow direction.

25. The apparatus of claim 21, wherein the sensor includes a strain gage for determining a strain associated with the rod movement in the flow direction.

26. The apparatus of claim 21, wherein the cantilevered rod extends through a wall of the conduit into the flowing stream, wherein the sensor is in a substantially dust free location.

27. The apparatus of claim 21, wherein a portion of the sensor device configured for disposal in the stream of particulate matter consists essentially of a single rod to minimize a disturbance to the flow of particulate matter.

28. A method for controlling the flow rate of a stream of particulate matter in a milling operation, comprising:

providing a flow direction to the stream;

extending a cantilevered rod into the stream;

flexing an elastic portion of a sensor device corresponding to forces acting on the rod by forces associated with the flow of the stream;

generating a control signal corresponding to the forces acting on the rod by the stream of particulate matter; and using the control signal to control the flow rate of the stream.

29. The method of claim 28, further comprising positioning the rod approximately perpendicular to the flow direction.

30. The method of claim 28, further comprising controlling an apparatus for adjusting an adjustable feed gap with the control signal.

31. The method of claim 28, further comprising controlling a segment assembly for shifting the stream of particulate matter with the control signal.

32. The method of claim 28, further comprising controlling a feed roller with the control signal.

33. The method of claim 28, further comprising controlling an adjustable grinding roller with the control signal.

* * * * *